US005462281A

United States Patent [19]

Gaito et al.

[11] Patent Number: 5,462,281

[45] Date of Patent: Oct. 31, 1995

[54] ELECTRIFIED BOARD GAME

[76] Inventors: Andre A. Gaito, 21 Laurel Hill Dr.; Donald C. Portofee, 12 Surrey La., both of Niantic, Conn. 06357

[21] Appl. No.: 268,495

[22] Filed: Jun. 30, 1994

[51] Int. Cl.[6] ..... A63F 3/02

[52] U.S. Cl. ..... 273/238; 273/260

[58] Field of Search ..... 273/237, 238, 273/260, 261

[56] References Cited

U.S. PATENT DOCUMENTS

| | | | |
|---|---|---|---|
| 2,679,397 | 5/1954 | Thacker | 273/237 |
| 3,395,463 | 8/1968 | Worden et al. | 273/237 X |
| 3,579,856 | 7/1968 | Way | 273/237 X |
| 3,757,322 | 9/1973 | Barkan et al. | 273/237 X |
| 3,888,491 | 6/1975 | Bernard et al. | 273/237 |
| 3,893,671 | 7/1975 | Gardner | 273/237 |
| 3,923,306 | 12/1975 | Cahn-Hidalgo et al. | 273/237 |
| 4,228,596 | 10/1980 | Daniel | 273/237 X |
| 4,391,447 | 7/1983 | Dudley | 273/238 |
| 5,082,286 | 1/1992 | Ryan et al. | 273/238 |
| 5,215,311 | 6/1993 | Schuller | 273/238 X |

*Primary Examiner*—William H. Grieb
*Attorney, Agent, or Firm*—Albert W. Hilburger

[57] ABSTRACT

A board game defines a plurality of playing positions in the form of a gridwork including a plurality of discrete, electrically isolated, metal frames, each frame enclosing one of the playing positions and supporting a translucent coextensive window. Playing pieces, some being of different types, are movable between playing positions in accordance with a predetermined pattern dependent upon their type and influenced by the locations of other playing pieces. A regulating system selectively alters a sensible characteristic at each of the playing positions to thereby alter an attribute of a playing piece which lands on a certain one of the playing positions. This is done by successively illuminating each of the playing positions by means of one or more colored electric lamps or by providing no illumination at all. The regulating system has a first operating mode for manually altering the illumination at each of the playing positions and a second operating mode for randomly altering the illumination at each of the playing positions. The regulating system also includes touch circuitry responsive to sequential touches by a user to operate, in sequence, a first lamp alone at a playing position, then a second lamp alone at that playing position, then no lamp at that playing position. The regulating system can also randomly operate the lamps at the playing positions, and is also capable of adjusting the time interval between random operations and the random number generating means and the number of the playing positions subject to such random operations.

15 Claims, 4 Drawing Sheets

FIG. 2.
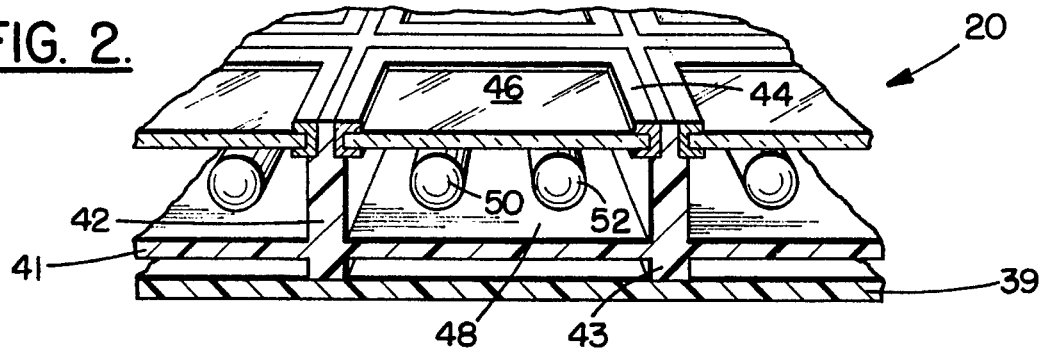
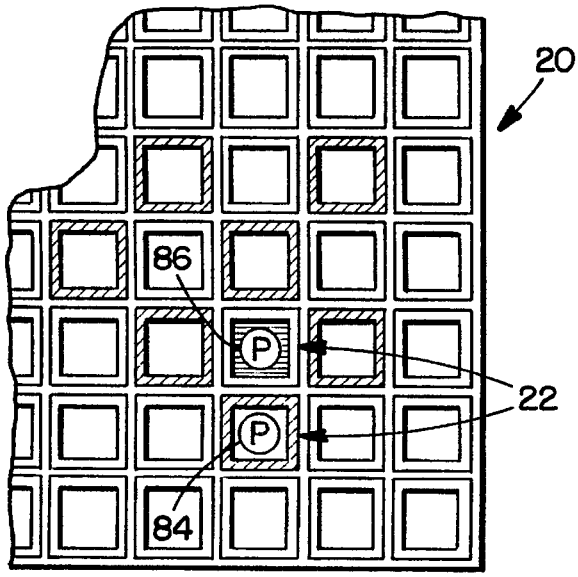
FIG. 7A.
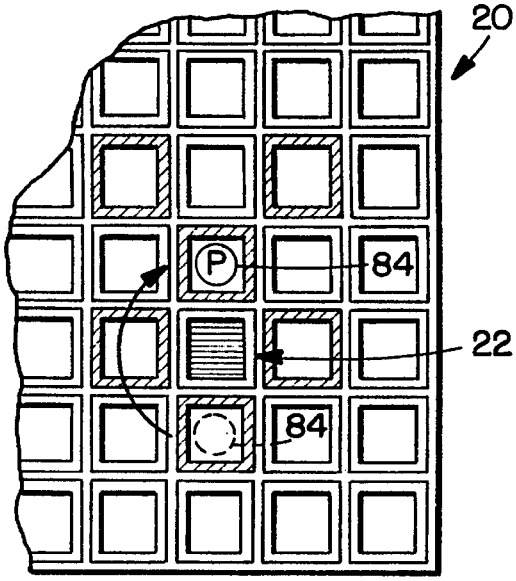
FIG. 7B.
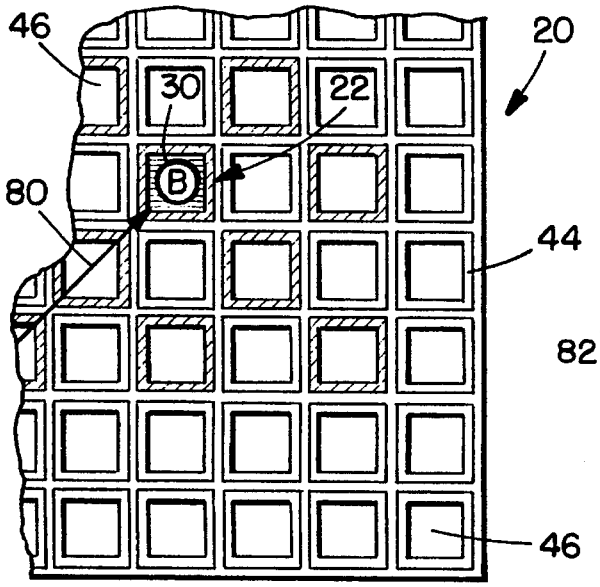
FIG. 6A.
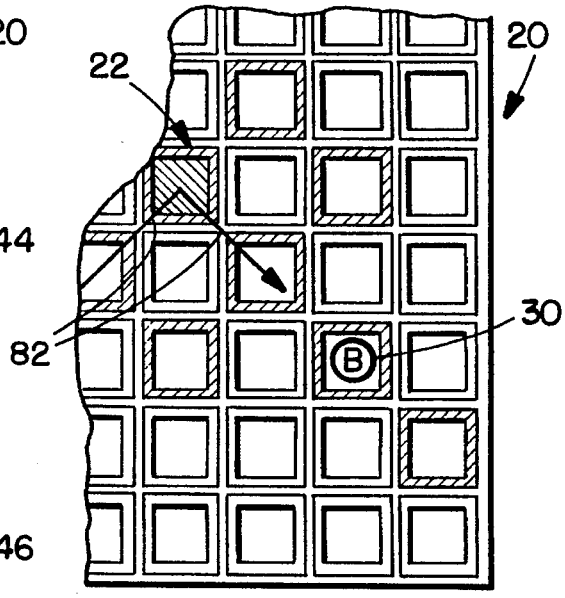
FIG. 6B.

ELECTRIFIED BOARD GAME

BACKGROUND OF THE INVENTION

1. Field of the Invention

The present invention generally relates to board games such as checkers and chess played on a grid and, more particularly, to a system for selectively adjusting the mode and level of play of the game.

2. Description of the Prior Art

Electronic games which provide visual aids to the players to assist them in their decision making are known for teaching the fundamentals of positional games, such as chess, checkers, and the like, to inexperienced players, or for assisting more experienced players in improving their game. A particularly useful teaching device for positional games is one which provides a visual indication to the players of their possible moves. For example, U.S. Pat. No. 3,893,671 to Gardner discloses a chess game comprising a chessboard having a socket on each square thereof into which the various chess pieces are plugged as they are moved on the board. A plurality of optical fibers interconnect the 64 squares of the chessboard, and each chesspiece contains a light source for directing light through a mask comprising a plurality of openings located in a predetermined pattern on the base of the chesspiece. The pattern of openings, which encodes each chesspiece according to its type, directs the light into selected ones of the optical fibers to illuminate the squares on the chess board to which the chesspiece is capable of moving. The Gardner device, however, does not take into consideration the positions of other playing pieces on the board, which influence the manner in which some chesspieces are able to move.

U.S. Pat. No. 2,679,397 to Thacker discloses another chess game in which squares that are under attack or which are defended by one or more chesspieces are illuminated. However, the Thacker device provides a bank of 64 switches for each player which must be manipulated in order to illuminate the squares. In U. S. Pat. No. 4,391,447 to Dudley, each playing piece is encoded in accordance with its identity, and each playing position automatically responds to the encoding when it is occupied by a playing piece. An electrical circuit associated with the playing position causes other positions to which the playing piece is capable of moving to be illuminated with an appropriate color. Each playing piece includes light sources which are illuminated when the playing piece is in jeopardy of being captured by an opposing playing pieces or is covered by a friendly playing piece. The intensity of attack and the depth of cover may also be indicated. The playing pieces are automatically oriented in a predetermined manner when they are placed on a playing position in order to establish electrical contact between electrical terminals on the base of the playing piece and electrical terminals on the playing position.

None of the patents mentioned, nor any others known to the applicant, are capable of selectively, arbitrarily, and possibly at random, adjusting the manner of play of a playing piece according to changes imposed on individual playing positions on the playing board.

It was in light of the foregoing that the present invention was conceived and has now been reduced to practice.

SUMMARY OF THE INVENTION

A board game defines a plurality of playing positions in the form of a gridwork including a plurality of discrete, electrically isolated, metal frames, each frame enclosing one of the playing positions and supporting a translucent coextensive window. Playing pieces, some being of different types, are movable between playing positions in accordance with a predetermined pattern dependent upon their type and influenced by the locations of other playing pieces. A regulating system selectively alters a sensible characteristic at each of the playing positions to thereby alter an attribute of a playing piece which lands on a certain one of the playing positions. This is done by successively illuminating each of the playing positions by means of one or more colored electric lamps or by providing no illumination at all. The regulating system has a first operating mode for manually altering the illumination at each of the playing positions and a second operating mode for randomly altering the illumination at each of the playing positions. The regulating system also includes touch circuitry responsive to sequential touches by a user to operate, in sequence, a first lamp alone at a playing position, then a second lamp alone at that playing position, then no lamp at that playing position. The regulating system can also randomly operate the lamps at the playing positions, and is also capable of adjusting the time interval between random operations and the random number generating means and the number of the playing positions subject to such random operations.

A primary object of the invention is to provide a board game such as checkers and chess, played on a grid, with provision for selectively adjusting the mode and level of play of the game.

Another object of the invention is to provide such a board game in which the players selectively alter the attributes of a playing piece when it lands on an altered position on the grid.

A further object of the invention is to provide such a game in which different levels of difficulty are provided.

Still a further object of the invention is to provide such a game in which the attributes of the playing piece can be altered when it lands on a particular position on the game board and in which changes are continuously being made, at random, at different positions on the game board.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and which constitute a part of this invention, illustrate some of the embodiments of the invention and, together with the description, serve to explain the principles of the invention in general terms. Like numerals refer to like parts throughout the disclosure.

BRIEF DESCRIPTION OF THE DRAWINGS

FIG. 2 is a detail perspective view, certain parts being cut away and shown in section, of a portion of the playing board of FIG. 1, taken generally along line 2—2 in FIG. 1;

FIGS. 6A, 6B, 7A, and 7B are all detail plan views of the playing board illustrated in FIG. 1, such detail plan views being used to describe typical movements of playing pieces in accordance with the invention.

DETAILED DESCRIPTION OF THE PREFERRED EMBODIMENTS

Figure 1:
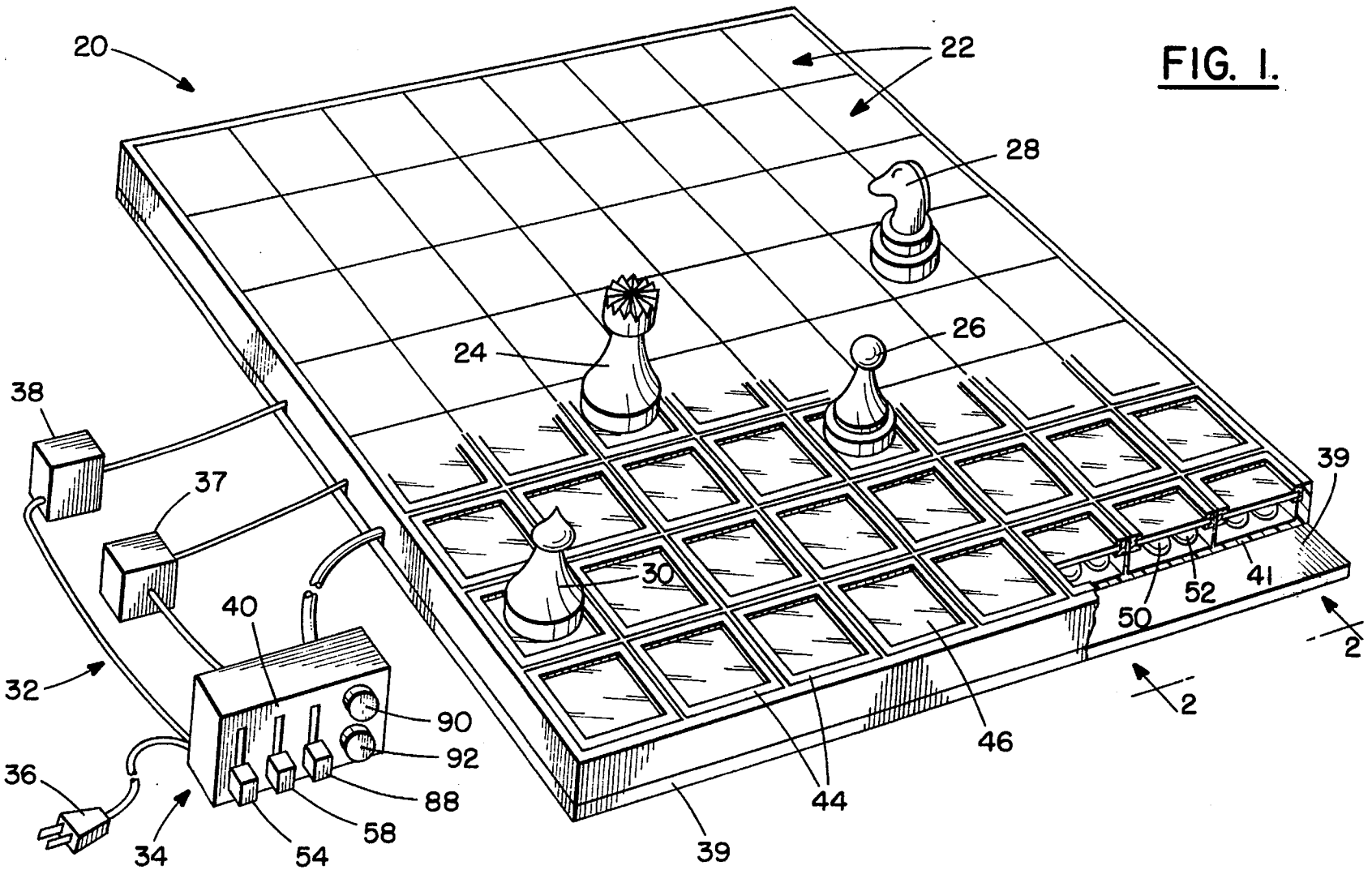
FIG. 1 is a perspective view of the playing board for an electrified game embodying the present invention, certain parts being cut away and shown in section.

Turn now to the drawings and, initially, to FIGS. 1 and 2 which generally depict a playing board 20 presenting a grid work defining a plurality of playing positions 22. A game to be played on the playing board 20 may be chess, for example, using a plurality of playing pieces which may be, for example, a king 24, a pawn 26, a knight 28, and a bishop 30. Each of these playing pieces is movable between playing positions 22 on the playing board 20 in accordance with a predetermined pattern dependent upon its type, and this predetermined pattern is influenced by the locations of other playing pieces controlled by an adversary.

A regulating mechanism 32 is operable in a manner to be described for selectively altering a sensible characteristic at each of the playing positions 22 and, by so doing, to thereby alter an attribute of one of the playing pieces which lands on a certain one of the playing positions.

The regulating mechanism 32 includes a controller 34 which is electrically energized when an attached plug 36 is connected to a suitable electrical outlet. Alternating current from the main line to which the plug 36 is connected passes through a control panel 40 to a transformer 37 which provides 9 v a.c. power and to a power supply 38 which converts line voltage into d.c. voltage. The output of both the transformer 37 and of the power supply 38 is connected to their respective locations on a circuit board 39 which is an integral part of the playing board 20. Thus, it can be said that the regulating mechanism 32 includes the controller 34, the transformer 37, the power supply 38, and the circuit board 39.

The control panel 40 of the controller 34 houses a number of controls which serve to alter the play of the game on the board 20. Before proceeding further with a description of the regulating mechanism 32, however, it would be desirable to describe further the construction of the playing board 20. With particular attention to FIG. 2, the playing board 20 is seen to include a base 41 preferably formed of a dielectric material such as plastic with regularly spaced upstanding partitions 42 extending both laterally and longitudinally in order to form a grid or squared pattern. Downwardly extending feet 43 may also be used to support the playing board on, but spaced from, the circuit board 39. Each individual grid defining a playing position 22 includes a metal frame 44 and neighboring frames are electrically isolated from one another. A translucent window 46 which may be of glass or plastic, for example, is supported in each metal frame and is generally co-extensive therewith. Thus, a plurality of isolated compartments 48 are thereby defined, each positioned beneath an associated one of the playing positions 22. A pair of electric lamps 50, 52 are suitably mounted within each compartment 48. The lamps 50, 52 emit different colors. For purposes of the present disclosure, when lamp 50 is energized, it glows with a blue color and when lamp 52 is energized, it glows with a green color. According to one concept of the invention, the lamps 50 and 52 may never be energized at the same time. However, according to another concept of the invention, they may be energized simultaneously to produce a third color.

Figure 3:
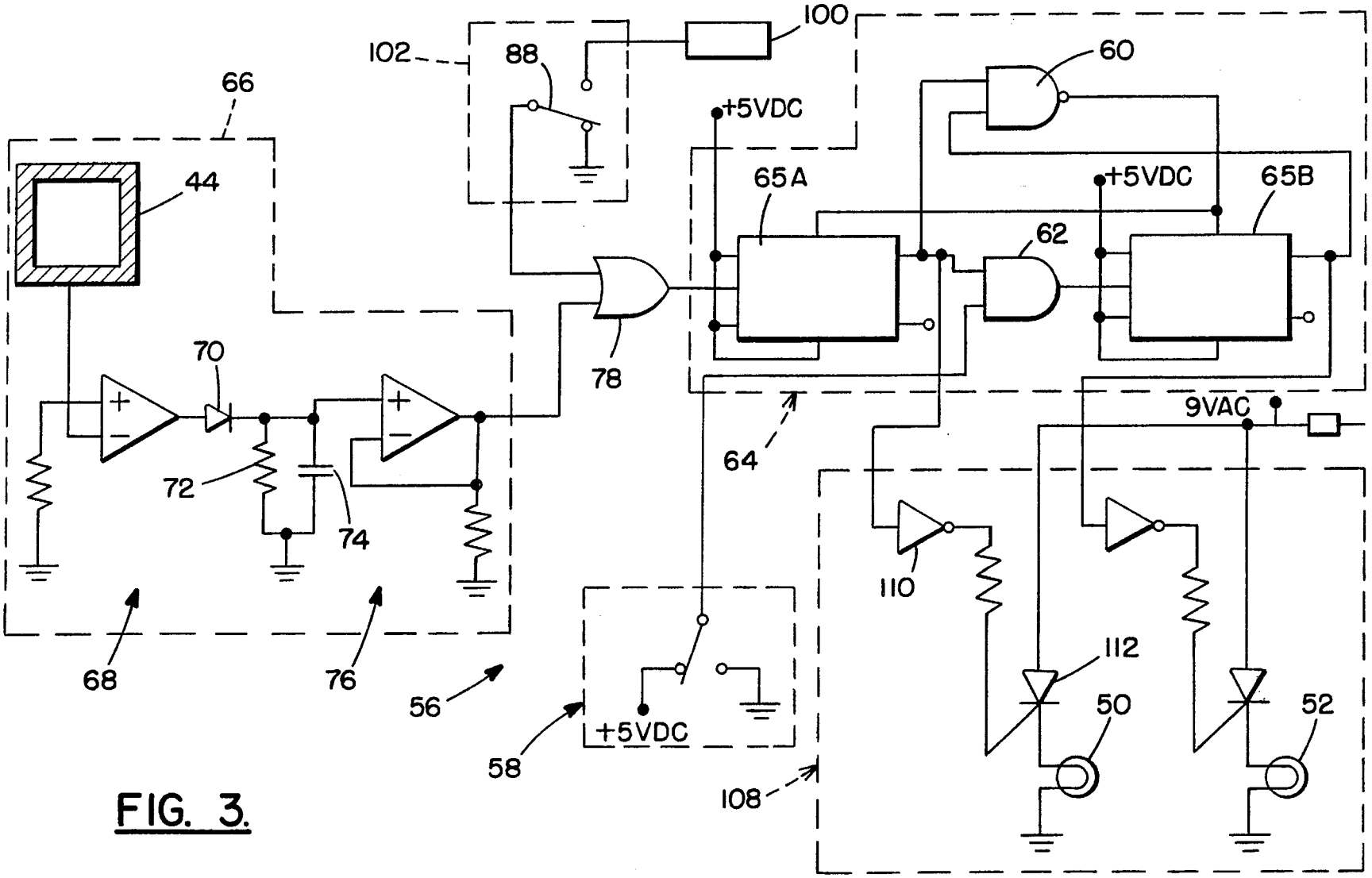
FIG. 3 is a schematic diagram of an electrical circuit employed by the invention.

Turn now to FIG. 3 and to FIGS. 4A through 4D in addition to FIGS. 1 and 2. It was earlier mentioned that the control panel 40 includes a number of controls for operating the playing board 20 of the present invention. While FIG. 3 presents an electrical schematic to explain the various operations performed by the invention, FIGS. 4A–4D diagrammatically depict various settings for the controls which can be interposed by the players of the game. Actually, FIG. 3 presents an electrical schematic for one of the playing positions 22 such that an entire playing board 20 is comprised of as many circuits 56 as there are playing positions.

Figure 4A:
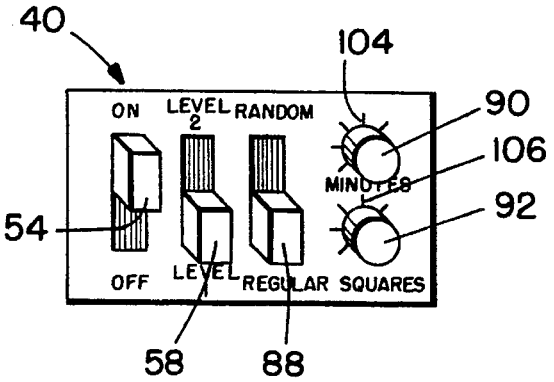
FIGS. 4A, 4B, 4C, and 4D depict the control panel of a controller illustrated in FIG. 1, each figure indicated operating controls in different positions.

In a first instance, an on-off switch 54 is movable between a lowered or "off" position and a raised or "on" position. As indicated in FIG. 1, with switch 54 being in a lowered position, the entire operating system 56 depicted in FIG. 3 is inactive such that playing board 20 is totally deenergized enabling a game to be played in a conventional manner. When the switch 54 is raised to the "on" position as depicted in FIG. 4A, there still is no change with respect to the playing board 20 until one or more additional operations have been performed. Such an additional operation may occur when a player touches a metal frame 44 at one of the playing positions 22. It is noted that a level of play switch 58, viewing FIG. 4A, is in a lowered position indicating "level 1" play, as opposed to "level 2" play which occurs when it is moved to a raised position.

Figure 5:
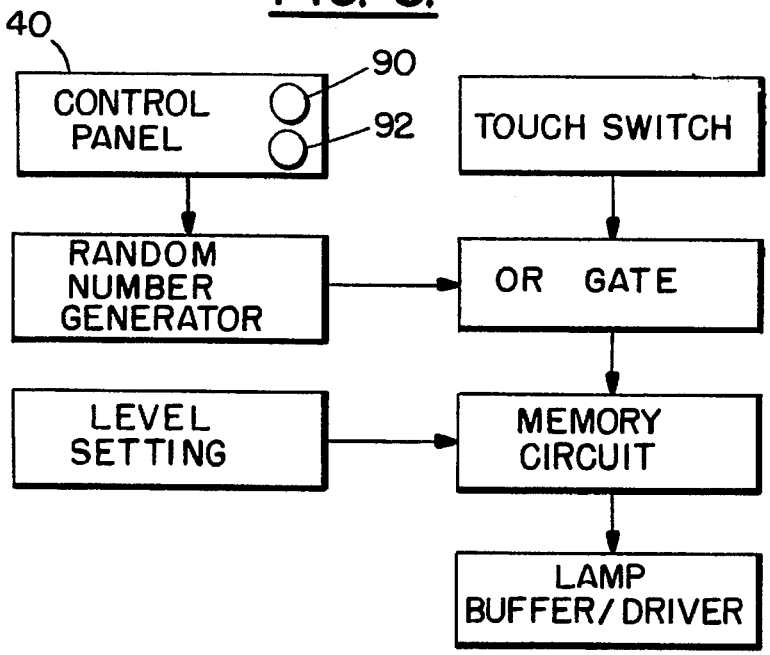
FIG. 5 is a flow diagram to indicate the operation of the invention.

With reference also to the electrical schematic diagram of FIG. 3 and to the flow diagram of FIG. 5, it is seen that level setting as performed by the switch 58 connects ground to AND gate 62 of a memory circuit 64 for level 1 and connects +5 volts for level 2. Thus, with switch 58 in the lowered or level 1 position, the blue lamp 50 is energized when a player touches the metal frame 44. A touch circuit 66 depends on the capacitance provided by the metal frame 44 when connected to an unbalanced operational amplifier 68. When the player touches the metal frame 44, the operational amplifier 68 oscillates and the oscillation is converted to a pulse by a diode 70, resistor 72, and capacitor 74. A second operational amplifier 76 is a unity gain follower to drive the TTL (transistor-transistor logic) load presented by an OR gate 78 between the touch circuit 66 and the memory circuit 64 (FIG. 3).

The memory circuit 64 is comprised of a pair of coupled J–K flip flops 65A, 65B. The pair of flip flops 65A, 65B can count from 0 to 1 if the second flip flop 65B is inhibited by the AND gate 62 or from 0 to 2 if not. The invalid 3 count is sensed by the NAND gate 60 which resets the counters to 0. It is in this manner that the changes to the playing board occur when a player sequentially touches the metal frame 44 at a playing position 22.

A lamp buffer and driver circuit 108 comprises an inverting TTL buffer 110 and silicon controlled rectifier (SCR) 112 for each lamp, 50, 52. The buffer 110 is driven by the memory flip flop output for that light and, in turn, drives the SCR 112 to the "on" state if a logical 1 is present at the flip flop Q output. The use of alternating current to drive either lamp 50, 52 is required to turn the SCR and thus either lamp to the "off" state when there is no longer a logical 1 at Q.

It was earlier explained that with the switch 54 in the depressed, or off, position as indicated in FIG. 1, the play of the game on the playing board 20 would proceed in a conventional manner. This would also be the case with switches 54 and 58 positioned as depicted in FIG. 4A, play on the playing board 20 continues to be of a conventional style. Play is altered, however, with the switches 54 and 58 in the positions indicated in FIG. 4A, when a player touches the metal frame 44 at one of the playing positions 22. In that instance, a blue lamp 50 is illuminated such that the entire window 46 at that playing position glows with a blue color. The next time the metal frame 44 at that particular playing position 22 is touched, the lamp 50 would be extinguished.

Figure 4B:
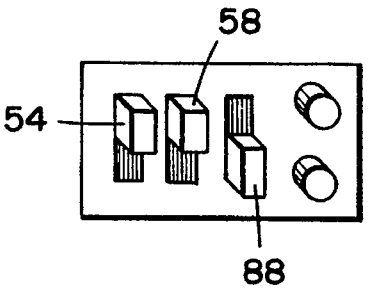

With the switches 54 and 58 in the relative positions indicated in FIG. 4B, that is, switch 54 is turned on and switch 58 is at the level 2 position, again, no change will occur on the playing board 20 until a player touches the metal frame 44 at a playing position 22. When a player does touch the metal frame 44 at a playing position, the blue lamp 50 is illuminated. Then, and this is where level 2 play differs from level 1 play, if a player removes a finger from the metal frame 44 at that playing position and then again touches the metal frame, the blue lamp 50 is extinguished but the green lamp 52 becomes illuminated. When the player again touches the metal frame 44 at that playing position, the green lamp 52 is extinguished and neither lamp becomes illuminated. In this condition, play at that particular playing position 22 proceeds once again in a conventional manner. It will be understood that a lamp, whether blue or green, will remain illuminated even when a player removes his finger from the metal frame 44 and before again touching the metal frame.

The activity just described can be performed at any one of the playing positions 22 on the playing board 20. A determination of whether the playing board 20 would be subjected to level 1 or level 2 operation and at which playing positions 22 such alterations would be made would be determined by agreement of the players. The specific effect to the play of a game will now be explained. For ease of explanation, it will be assumed that the game being played is chess, although the invention is not intended to be so limited.

The color with which a playing position 22 is illuminated may either restrict or enhance the movement of a chess piece. Since different attributes can be assigned to the colors effecting the movements of a chess piece, a variety of chess games can be played or created. It was earlier mentioned that the lamps 50, 52 could be simultaneously illuminated. In such an instance, the third color thereby produced might lend yet another attribute to effect the movements of a chess piece.

Turn now to FIGS. 6A and 6B for a specific explanation of how different attributes can be assigned to a chess piece to effect its movements. In this disclosure, the explanation will be with respect to a bishop 30, although it can apply to any other playing piece of a chess game or of any other board game. As is customary, the bishop 30 moves diagonally across the playing board 20. In FIG. 6A, the indication is that the bishop 30 has been moved in a direction of an arrow 80 to the particular playing position 22 on which the bishop 30 is indicated. It might have been agreed by the players before play of the game begins that a bishop must stop on any blue playing position. This, in effect, restricts the movement of that particular chess piece, thereby altering its attribute. The playing position 22 illustrated in FIG. 6A is depicted as being illuminated by the blue lamp 50. Hence, movement of the bishop 30 as indicated by the arrow 80 must terminate at that particular playing position.

In an alternative situation, as illustrated in FIG. 6B, the players might have agreed that when the playing position 22 is illuminated in green, that the movement of the bishop 30 is enhanced, enabling it to rebound or change its direction of movement as indicated by the arrow 82. Under the rules of the chess game as modified by the invention, a playing piece would be subject to the color being displayed at a playing position 22 at the time that the playing piece arrived at that playing position. If the color subsequently changed, that playing piece would not be effected until it left and were subsequently to return to that particular playing position.

Standard rules in moving a chess piece might be, for example:

A. A chess piece may only use the attribute of one playing position 22 per turn.

B. After a chess piece has been moved onto a playing position 22, the player will touch the metal frame 44 of that playing position.

C. When a chess piece has been moved onto an illuminated playing position 22, the color of that playing position is the attribute the chess piece acquires, not the color of the playing position after the player touches the metal frame.

D. A chess piece may not use the attribute of an illuminated square that is occupied by an opponent's playing piece which cannot be captured.

For an explanation of the last rule just presented, the reader's attention is directed to FIGS. 7A and 7B. As depicted in FIG. 7A, pawns 84, 86 of opposing players are on adjacent playing positions 22. In its turn, pawn 84 is not able to capture pawn 86 because the playing position 22 of pawn 86 is illuminated. In contrast, as depicted in FIG. 7B, if the same playing position indicated in FIG. 7A as being occupied by the pawn 86 is unoccupied as seen in FIG. 7B, then, the pawn 84 may have an enhanced attribute enabling it to jump over that particular playing position, advancing two playing positions rather than only one as is customary.

Hence, it will be seen that when creating a game utilizing the principles of the present invention, whether it be chess or some other game, the players must decide upon the approach of the game and how the different colors effect the movement of the playing pieces.

The following are some of the approaches which the players of the game may want to consider:

(a) Each time a playing piece is moved onto a playing position 22, the player MUST change the color of that playing position by touching the metal frame 44.

(b) Each time a playing piece is moved onto a playing position 22, the player can CHOOSE if the color of that playing position will change. The player has the option of touching the metal frame 44 to change the color of that playing position depending on the player's strategic needs.

(c) Both players agree which playing pieces will automatically change the color of the playing position 22 onto which it is moved. This could be combined with approach (b).

(d) Both players agree to the number of times each is able to change the colors illuminated at the different playing positions 22. When both players have reached their agreed upon limit, the playing board 20 will have various colored playing positions which cannot be changed. The remainder of the game will be played on this newly created playing board.

(e) Both players agree on which playing positions or rows or columns of playing positions which can change colors during a game.

(f) Each color can represent a different level and only playing pieces may attack other playing pieces on the same level or on a lower level. For example, if a playing position is not illuminated, this could represent level 1. If the color of the playing position is blue, this could represent level 2. If the color of the playing position is green, this could represent level 3. Under these rules, only the playing pieces on level 3 can attack playing pieces on levels 1, 2, 3; playing pieces on level 2 can only attack playing pieces on levels 1, 2; and playing pieces on level 1 can only attack playing pieces on level 1.

(g) Both players choose which playing pieces are restricted from a color, and are banned from moving unto playing positions of that color. If an opponent's playing piece is on one of these playing positions, the forbidden playing piece is allowed to move onto the playing position to capture opponent's playing piece.

(h) Both players may adhere to the same set of rules which effect the movements of their playing pieces; or, each player may use a different set of rules which effect the movement of his or her particular playing pieces.

In the foregoing discussion, the metal frame 44 at each of the playing positions 22 had to be manually touched to change the color at that playing position and thereby effect the attribute of a playing piece landing on that playing position. This might be referred to as "regular" play. As defined by a mode switch 88, viewing FIGS. 1 and 4A–4D. Such "regular" play is achieved when the mode switch 88 is in its depressed position as depicted in FIGS. 1, 4A, 4B, and 4D.

Figure 4C:
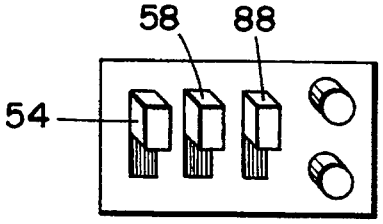
Figure 4D:
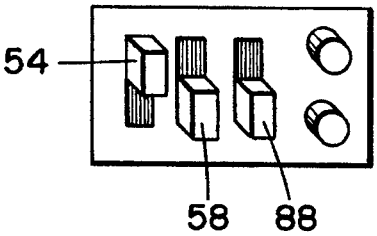

In contrast, "random" play occurs when the mode switch 88 is in the raised position as depicted in FIG. 4C. When the mode switch 88 is so positioned, the operating system 56 selects which playing positions will change color and when such changes will occur. Instructions for these latter changes are manually programmed by the players by means of the control knobs 90 and 92.

A random number generator 100 comprised of a white noise generator driving an analog to digital converter may be connected to the operating system 56 via an interface 102 including the mode switch 88. The timer control knob 90 may be positioned at any one of a desired variety of settings, for example, between one and fifteen minutes as indicated on a dial 104 formed on the control panel 40. In effect, the timer control knob 90 sets how often the analog to digital converter within the random number generator 100 is triggered. The playing position control knob 92 can similarly be moved to a plurality of positions as indicated by a dial 106 provided on the control panel 40. The dial 106 for the playing board 20 for chess, for example, may be graduated between 1 and 64 to cover all of the playing positions 22 of a chess board. Turning the control knob 92 determines how many bits of the digital word are used.

Thus, by reason of the mode switch 88 being moved to a raised position, the color being displayed at a playing position 22 depends on the previous color displayed at that position and on which level of play is provided for by the switch 58 and by the settings of the control knobs 90, 92.

The OR gate 78 allows the memory circuit 64 to be triggered by either the touch circuit 66 (energized when a player touches a metal frame 44) or by the random number generator 100.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A board game comprising:

a playing board defining a plurality of playing positions;

a plurality of interactive playing pieces, each playing piece being movable between playing positions in accordance with a predetermined pattern dependent upon its type, said predetermined pattern being influenced by the locations of other ones of said playing pieces; and regulating means operable for selectively altering a sensible characteristic at each of said playing positions to thereby alter an attribute of a playing piece which lands on a certain one of said playing positions.

2. A board game as set forth in claim 1 wherein at least some of said playing pieces are of different types.

3. A board game as set forth in claim 1 wherein said regulating means includes means for selectively illuminating each of said playing positions.

4. A board game as set forth in claim 1 wherein said regulating means includes display means for selectively producing at each of said playing positions at least first and second sensible characteristics, each sensible characteristic representing a different attribute to which a playing piece becomes subject upon landing on a certain one of said playing positions.

5. A board game as set forth in claim 4 wherein said playing board is in the form of a gridwork having a plurality of grids, each of said individual grids defining one playing position including:

a metal frame electrically isolated from its neighboring ones of said grids; and a translucent window supported in said metal frame and coextensive therewith; and wherein said regulating means includes means for selectively producing at each of said individual grids at least first and second sensible characteristics, each sensible characteristic representing a different attribute to which a playing piece becomes subject upon landing on a certain one of said playing positions.

6. A board game as set forth in claim 4 wherein said display means includes:

first and second electric lamps capable, when energized, of illumination in first and second colors, respectively;

a source of EMF; and main switch means for electrically connecting said first and second lamps to said source of EMF for selective energization thereof.

7. A board game as set forth in claim 1 wherein said playing board includes:

a metallic framework including a plurality of discrete, electrically isolated, frames, each of said frames enclosing one of said playing positions; and a window member in each of said frames and substantially coextensive therewith, each said window member being capable, upon operation of said regulating means, of displaying each of the sensible characteristics as altered by said regulating means.

8. A board game as set forth in claim 7 wherein said window member is composed of a translucent material.

9. A board game as set forth in claim 1 wherein said regulating means includes:

first operating mode means for manually selectively altering the sensible characteristic at each of said playing positions; second operating mode means for randomly altering the sensible characteristic at each of said playing positions; and mode switch means for selectively choosing operation of said first operating mode means and of said second operating mode means.

10. A board game comprising:

a playing board defining a plurality of playing positions including:

a metallic framework including a plurality of discrete, electrically isolated, frames, each of said frames enclosing one of said playing positions; and a window member in each of said frames and substantially coextensive therewith, each said window member being capable, upon operation of said regulating means, of displaying each of the sensible characteristics as altered by said regulating means;

a plurality of playing pieces, each playing piece being movable between playing positions in accordance with a predetermined pattern dependent upon its type, said predetermined pattern being influenced by the locations of other ones of said playing pieces; and regulating means operable for selectively altering a sensible characteristic at each of said playing positions to thereby alter an attribute of a playing piece which lands on a certain one of said playing positions, said regulating means including:

first and second electric lamps positioned behind each of said window members in each of said frames, said lamps capable, when energized, of illumination in sensible characteristics defined as first and second colors, respectively;

a source of EMF; and main switch means for electrically connecting said first and second lamps to said source of EMF for selective energization thereof.

11. A board game as set forth in claim 10 wherein said regulating means includes touch circuitry responsive to sequential touches by a user of said frame at a certain one of said playing positions to operate, in sequence, said first lamp alone at said playing position to thereby display the first color, then said second lamp alone at said playing position to thereby display the second color, then no lamp at said playing position to thereby display no color.

12. A board game as set forth in claim 10 wherein said regulating means includes random number generating means for randomly operating said first and second lamps at least one of said playing positions.

13. A board game as set forth in claim 10 wherein said regulating means includes:

random number generating means operable for randomly operating said first and second lamps at least one of said playing positions;

timer control means for setting the time interval between operating said random number generating means; and position control means for setting the number of said playing positions subject to operation of said random number generating means.

14. A board game as set forth in claim 10 wherein said window member is composed of a translucent material.

15. A board game as set forth in claim 10 wherein said regulating means includes:

first operating mode means for manually selectively altering the sensible characteristic at each of said playing positions; second operating mode means for randomly altering the sensible characteristic at each of said playing positions; and mode switch means for selectively choosing operation of said first operating mode means and of said second operating mode means.

* * * * *